United States Patent [19]

Mennicke et al.

[11] Patent Number: 5,074,884

[45] Date of Patent: Dec. 24, 1991

[54] PROCESS FOR THE DYEING OF LEATHER WITH ANIONIC DYES AND POLYAMINOAMIDE RESIN AS DYEING AUXILIARY

[75] Inventors: Winfried Mennicke; Harro Träubel, both of Leverkusen, Fed. Rep. of Germany

[73] Assignee: Bayer Aktiengesellschaft, Leverkusen, Fed. Rep. of Germany

[21] Appl. No.: 591,926

[22] Filed: Oct. 2, 1990

[30] Foreign Application Priority Data

Oct. 18, 1989 [DE] Fed. Rep. of Germany ..... 3934713

[51] Int. Cl.[5] ..... D06P 3/32; D06P 1/52; C09B 67/24

[52] U.S. Cl. ..... 8/436; 8/437; 8/554; 8/602; 8/527

[58] Field of Search ..... 8/436, 554

[56] References Cited

U.S. PATENT DOCUMENTS

| | | | |
|---|---|---|---|
| 2,913,301 | 11/1959 | Streck | 8/437 |
| 2,913,302 | 11/1959 | Streck | 8/437 |
| 4,857,586 | 8/1989 | Bachem et al. | 524/845 |
| 4,875,900 | 10/1989 | Singh et al. | 8/94.27 |
| 4,975,499 | 12/1990 | Bachem et al. | 525/430 |

FOREIGN PATENT DOCUMENTS

| | | |
|---|---|---|
| 316730 | 5/1989 | European Pat. Off. . |
| 332967 | 9/1989 | European Pat. Off. . |
| 3517804 | 11/1986 | Fed. Rep. of Germany . |
| 1092965 | 11/1967 | United Kingdom . |
| 1466968 | 3/1977 | United Kingdom . |

*Primary Examiner*—A. Lionel Clingman

*Attorney, Agent, or Firm*—Sprung Horn Kramer & Woods

[57] ABSTRACT

To improve the affinity of anionic dyestuffs in the dyeing of leather materials, polycondensation products consisting of at least one amine of the formula

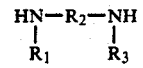

(I)

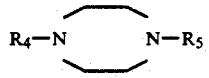

(II)

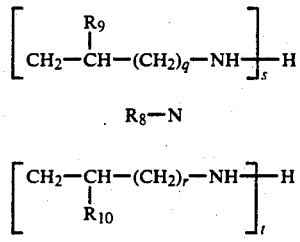

(III)

in which the radicals have the meanings mentioned in the description with one dicarboxylic acid and, if desired, ω-aminocarboxylic acid or its lactam are highly suitable.

6 Claims, No Drawings

PROCESS FOR THE DYEING OF LEATHER WITH ANIONIC DYES AND POLYAMINOAMIDE RESIN AS DYEING AUXILIARY

It is generally known that different types of leather, such as, for example, vegetable tanned leathers or chrome leathers retanned by means of vegetable or synthetic tanning materials, have only moderate affinity for anionic dyestuffs and often give dyeings which have only weak or at best medium-high colour strength.

Furthermore, it is known (cf. DE-A 2,552,750) that the colour depth can be substantially increased by using cationic auxiliaries in the dyeing by means of anionic dyestuffs. The leathers are preferably pretreated by means of the auxiliaries, in which the anionic character of the leather is weakened or its polarity even reversed to cationic activity. However, in the subsequent dyeing, there is a risk that a film of auxiliary and dyestuff may be deposited on the surface of the leather, with all the associated disadvantages, such as bronzing effects, change in hue, levelness problems, insufficient penetration dyeing and low rub and solvent fastness.

Results which are better in this respect are obtained according to processes of DE-A 3,517,804.

However, the amines and polyamines, which may be alkylated or oxalkylated, used in this process have the tendency to grease in powder formulations and to decompose into ammonia and volatile amines.

It is true that through neutralization of these auxiliaries by means of Brönsted acids it has been possible, according to DE-A 3,738,962, to prepare stable dyestuff/auxiliary preparations, but these preparations produce specky dyeings on the leather substrates in some Surprisingly, it has now been found that the above-mentioned disadvantages can be avoided completely or predominantly and excellent dyeings can be obtained by using, as auxiliaries for the dyeing, polyaminoamide resins obtainable by condensation of at least one amine from the series a) diamines of the formula

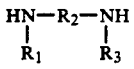

(I)

in which $R_1$, $R_3$, independently of one another, represent hydrogen, unsubstituted or hydroxyl-substituted $C_1$–$C_{10}$-alkyl, preferably $C_1$–$C_4$-alkyl, or a radical formed by addition of 2–4 ethylene oxide, propylene oxide and/or butylene oxide, and represents $C_2$–$C_9$-alkylene or a divalent radical of the formula

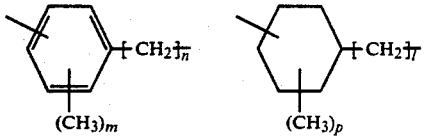

-continued

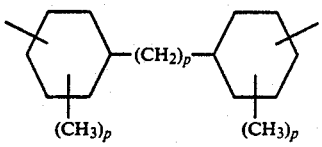

n represents 1 or 2, m, 1 represent 0 or 1 p represents 0, 1, 2 or 3, b) piperazine derivatives of the formula

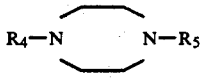

(II)

in which $R_4$, $R_5$, independently of one another, represent hydrogen, $C_1$–$C_4$-alkyl or the radical $R_6$—NH—$R_7$—, $R_6$ represents $C_1$–$C_4$-alkyl and $R_7$ represents $C_2$–$C_4$-alkylene, and c) polyamines of the formula

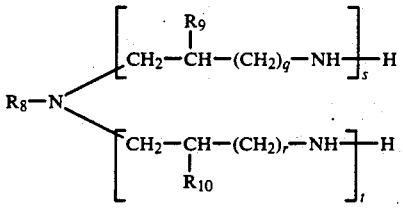

(III)

in which $R_8$ represents hydrogen or unsubstituted or hydroxyl-substituted $C_1$–$C_4$-alkyl, $R_9$, $R_{10}$ independently of one another, represent hydrogen, methyl or ethyl, q, r, independently of one another, represent 0, 1, 2, 3 or 4 and s, t, independently of one another, represent 1, 2, 3, 4, 5 or 6, with at least one aliphatic saturated $C_2$–$C_{12}$-dicarboxylic acid, olefinically unsaturated $C_4$–$C_{12}$-dicarboxylic acid or aromatic dicarboxylic acid or functional derivatives thereof and, if desired, a $C_3$–$C_8$-ω-aminocarboxylic acid or its lactam, in which the amines of the formulae (I), (II) and (III) and the dicarboxylic acids or their derivatives are reacted with one another in such amounts that a molar excess of the amino groups with respect to the carboxyl groups results.

In particular those condensation products are suitable for the dyeing of leather which are based on at least one of the amines defined above and one mixture of a dicarboxylic acid, preferably glutaric or adipic acid, and a $C_3$–$C_8$-•-aminocarboxylic acid or its lactam, preferably 6-caprolactam.

Furthermore, it is favourable for the properties of the auxiliary if the amine component used is a mixture of a diamine of the formula (I) and a polyamine of the formula (III).

Of interest are in particular condensation products of combinations of a diamine of the formula (I) and a polyamine of the formula (III) with combinations of glutaric or adipic acid and 6-caprolactam.

The molar ratio of the polyamines of the formula (III) to the diamines of the formula (I) and of the glutaric or adipic acid to 6-caprolactam can vary within wide limits and is in both cases preferably greater than 1.

It has a very favourable effect on the properties as dyeing auxiliaries if the ratio of all reactants participating in the condensation reaction is selected such that polyaminoamides having a basic equivalent weight of 143 to 1,000 are formed and are miscible with water in virtually any ratio. Likewise, all parameters should be selected such that a 1% strength auxiliary solution remains without a precipitate at 20° C. for at least 10 minutes.

Examples of diamines of the formula (I) are:

Ethylenediamine, N-(2-hydroxyethyl)ethylenediamine, N-methylethylenediamine, N,N,-dimethylethylenediamine, 1,2-diaminopropane, 1,3-diaminopropane, N-methyl-1,3-diaminopropane, N,N'-dimethyl-1,3-diaminopropane, N,N'-bis[2-hydroxyethyl]-1,3-diaminopropane, 1,3-diaminobutane, 1,4-diaminobutane, N,N'-dimethyl-1,4-diaminobutane, 1,6-diaminohexane, 3-methyl-1,5-diaminopentane, isomer mixture of 2,2,4- and 2,4,4-trimethyl-1,6-diaminohexane, 1,4-diaminocyclohexane, 1-methyl-2,4- and -2,6-diaminocyclohexane, 1-amino-3,3,5-trimethyl-5-aminomethylcyclohexane, 4,4,-diaminodicyclohexylmethane, 1,3-bis[4-aminocyclohexyl]propane, 4-aminobenzylamine, 4aminophenylethylamine, 4-aminophenylethylamine or 1,3-bis[aminomethyl]benzene.

Examples of piperazine derivatives of the formula (II) are piperazine, aminoethylpiperazine, N,N'-bis[2-aminoethyl]piperazine.

Suitable polyamines of the formula (III) are:

Diethylenetriamine, triethylenetetramine, tetraethylenepentamine, pentaethylenehexamine, hexaethyleneheptamine, heptaethyleneoctamine, bis[3-aminopropyl]amine, bis[2-aminopropyl]amine, 3-(3-diethylaminopropylamino)propylamine, methyl-, ethyl-, 2-hydroxyethyl- and n-butyl-bis[3-aminopropyl]amine, 1,3-bis[2-aminoethylamino]propane, 1,2-bis[2-aminopropylamino]propane, 1,3-bis[3-aminopropyl]propane, bis[hexamethylene]triamine, 1,6-bis[2-aminoethylamino]hexane, 1,6-bis[3-aminopropylamino]hexane, N-3-aminopropyltetramethylenediamine or N,N'-bis[3-aminopropyl]tetramethylenediamine.

Examples of suitable dicarboxylic acids are:

Oxalic acid, malonic acid, maleic acid, fumaric acid, itaconic acid, succinic acid, glutaric acid, adipic acid, azelaic acid, sebacic acid, 1,12-dodecanedioic acid, terephthalic acid and isophthalic acid.

Suitable "functional derivatives" are their anhydrides or alkyl esters and alkyl monoesters.

Suitable ω-aminocarboxylic acids and their lactams are:

6-Aminocaproic acid, 8-aminocaprylic acid, 6-caprolactam and 8-capryllactam.

The polyaminoamides to be used according to the invention are known per se (cf. e.g. DE-A 3,808,741).

The preparation of these resins from the above-mentioned components can likewise be carried out in a known manner, for example by heating the corresponding amine and carboxylic acid components at atmospheric pressure at temperatures in the range from 110 to 250° C., preferably from 140 to 210° C. The mixture is first refluxed and then the temperature is allowed to increase to 210° C. over a period of several hours, while the water of the reaction is simultaneously removed. The viscous reaction mass formed can be adjusted to a viscosity which has favourable handling by dilution with water.

The various leather materials which are suitable for the process according to the invention for the dyeing of leather include chrome leather, leathers retanned with vegetable, synthetic or a combination of tanning materials, velour leather, split velour, nubuk or wool skins and pelts. The leathers can have different thicknesses, including thin leathers, for example glove leather, leather of medium thickness, such as shoe upper leather and garment leather, and thick leathers, such as upholstery, suitcase leather and leather for sporting goods.

The anionic dyestuffs used in the dyeing process according to the invention can be acid, sulpho-containing metal complex, direct, mordant, reactive and solubilized sulphur dyestuffs. They are in particular the sulphur-containing dyestuffs customarily used for the dyeing of leather, such as are described, for example, in G. Otto, Das Färben des Leders [the Dyeing of Leather](1962) pp. 51–90 and pp. 107–143 or in J.F. Feeman, "The Chemistry of Synthetic Dyes", edited by Venkataraman (1978) pp. 42–73. The sulpho-containing leather dyestuffs are predominantly used in the form of their alkali metal or ammonium salts.

The water-soluble polyaminoamide resins which are effective auxiliaries can be applied to the leather in amounts of 0.5–50, predominantly 5–20%, by weight of the amount of dyestuff, before, simultaneously with, or after the dyestuffs.

A preferred process is the simultaneous application of dyestuff and auxiliary, in which advantageously preparations consisting of dyestuff and auxiliary are used. The preparations are obtained by incorporating the auxiliary in the dyestuff in an amount which is favourable for the dyeing process. The resulting dyestuff formulations can be used in any desired forms, for example as powder preparations, liquid formulations or granulates. Apart from the auxiliaries according to the invention, they can additionally contain further, customary fillers and auxiliaries, in particular inorganic salts such as sodium chloride, sodium sulphate, sodiua carbonate, buffer mixtures, alkalis such as lithium hydroxide or potassium hydroxide, non-electrolyte fillers such as dextrin, sugar, urea, starch, anionic surfactants such as lignosulphonates, alkylnaphthalenesulphonic acids, alkylbenzenesulphonic acids, nonionic surfactants such as ethylene oxide adducts with alkylphenols, dedusting agents, such as phthalic acid esters. Further auxiliaries can be humectants, preservatives, hydrotropic substances or solvents.

The dyestuff formulations are preferably present in solid form as homogeneous mixtures of sulpho-containing dyestuffs, the auxiliaries according to the invention and electrolyte-like fillers. The homogeneous mixtures can be contained in particular by dissolving or suspending these components in water, followed by spray-drying. A further variation is to add the auxiliary to the dyestuff during or after its synthesis but still before its isolation and to spray-dry the dyestuff together with the auxiliary and the filler.

The leathers are preferably dyed in an aqueous bath at the customary liquor ratios of 50 to 1,000% by weight of water, relative to the shaved or dry weight of the substrate. The amount of dyestuff supplied can be 0.01 to 15% by weight, depending on the type of leather and the desired colour depth. The pH of the dyeing liquor is predominantly maintained at 4.0 to 8.0 and the dyeing temperature predominantly at 25 to 70° C.

The auxiliaries to be used according to the invention make it possible to achieve excellent bath exhaustion and a good colour depth. A good penetration dyeing of the leathers is achieved and uniform leather dyeings which have good fastness properties are obtained. The good light and migration fastness and the good wet fastness properties, such as perspiration, and seawater fastness and resistance to water drops may be mentioned in particular.

Compared with similar auxiliaries known from German Patent Specification 1,469,727, the polyaminoamides claimed are distinguished, for example, by better dye bath stability, i.e. by a decreased tendency to form precipitates.

A. Preparation of the polyaminoamide resins

Example 1

To an initially introduced mixture of 123.6 g of diethylenetriamine, 51 g of ethylenediamine and 113 g of 6-caprolactam are added with stirring 292 g of adipic acid. The mixture is refluxed at 140–150° C. for 45 minutes, the reflux condenser is then exchanged for a Claisen head and heating is continued for about another three hours, while separating out the water of the reaction, until the inside temperature has risen to 197° C. The melt is then allowed to cool to 165° C., 508 ml of water are carefully added, and stirring of the solution at 90° C. is continued for another hour.

The mixture is cooled to 25° C. to give 1,010 g of an amino-containing resin having a base equivalent weight of 732, a solids content of 49.6% and a viscosity of 383 mPas.

A similar product is obtained by replacing the 51 g of ethylenediamine by an equivalent amount of 1,2-diaminopropane and otherwise repeating the procedure.

Example 2

A mixture of 123.6 g of diethylenetriamine, 51 g of ethylenediamine and 153 g of 6-caprolactam is treated with 292 g of adipic acid under the same conditions as described in Example 1. The melt is diluted with 548 ml of water and stirred again at 90–95° C. for another hour to give 1,090 g of an aqueous polyaminoamide resin. The solids content is 49.9% by weight, the base equivalent weight is 792 and the viscosity (25° C.) 399 mPas.

A similar product which, however, has a lower base equivalent weight is obtained by replacing the 123.6 g of diethylenetriamine of this example with a mixture of 82.4 g of diethylenetriamine and 58.4 g of triethylenetetramine.

B. Preparation of the dyestuff/auxiliary preparations

Example 3

71.5 g of the sodium salt of the black dyestuff obtained by diazotization of 4,4'-diaminostilbene-2,2'-disulphonic acid and p-nitroaniline and coupling of the product onto 8-amino-1-naphthol-3,6-disulphonic acid, resorcinol and 1,3-diaminobenzene are suspended in 350 ml of water. 30 g of the polyaminoamide condensation product according to Example 1 and 6.5 g of sodium sulphate are added, and the mixture is stirred vigorously for three hours. The product is worked up by spray-drying through a two-component nozzle at an inlet temperature of 180° C. and an outlet temperature of 80° C. Finally it is dedusted by means of 2 g of an oil/emulsifier mixture to give about 100 g of a dyestuff/auxiliary preparation which has good water-solubility and a long shelf life.

Example 4

0.2 mol of 4-amino-4'-nitrodiphenylamine-2'-sulphonic acid are diazotized in the usual manner and coupled onto 0.195 mol of 1-aminonapthalene-6-sulphonic acid in an aqueous medium buffered acetate. The monoazo dyestuff thus obtained is in turn diazotized and coupled onto 0.185 mol of resorcinol in sodium hydroxide solution. Rediazotization of 0.2 mol of 4-amino-4'-nitrodiphenyl-2'-sulphonic acid and coupling onto the reaction product with resorcinol leads to the red-brown suspension of the trisazo dyestuff. 138 g of polyamineamide of Example 1, 80 g of sodium sulphate and 7.5 g of the oil/emulsifier mixture are added to the suspension, the mixture is vigorously stirred for one hour and spray-dried at an inlet temperature of 180° C. and an outlet temperature of 80° C. A stable dyestuff product which gives a dark red on dyeing is obtained.

In the examples which follow, the composition of further preparations consisting of dyestuffs, auxiliaries, fillers and dedusting agents is shown. They are prepared by stirring in the five-fold amount of water for one to two hours, followed by spray-drying at an inlet temperature of 180° C. and an outlet temperature of 80° C.

Example 5

41 g of a red-brown dyestuff, obtained by diazotization of 4-amino-4'-nitrodiphenylamine-2'-sulphonic acid, coupling onto a 1:1 mixture of 1-naphthylamine-6-and -7-sulphonic acid, diazotization of the reaction products, coupling onto phenol, salting out with sodium chloride, filtering off the precipitate with suction and drying it, 48 g of sodium sulphate, 18 g of the auxiliary according to Example 1 diluted with water, 2 g of an oil/emulsifier mixture Example 6

61 g of the dyestuff C.I. Acid Black 1, 20 470

26 g of sodium sulphate, 22 g of the auxiliary according to Example 1 diluted with water, 2 g of an oil/emulsifier mixture Example 7

58 g of the dyestuff C.I. Acid Black 26, 27 070

30 g of sodium sulphate, 20 g of the auxiliary according to Example 1 diluted with water, 2 g of an oil/emulsifier mixture Example 8

52 g of a grey dyestuff, obtained by 1:2 chroming of the two dyestuffs from diazotized 2-amino-4-nitrophenol-6-sulphonic acid and 2-amino-8-hydroxynaphthalene-6-sulphonic acid and diazotized 2-amino-4-nitrophenol-6-sulphonic acid and 2-(3,-sulphophenyl-)amino-8-hydroxynaphthalene-6-sulphonicacid, salting out with sodium chloride, filtering off the precipitate with suction and drying it, 36 g of sodium sulphate, 20 g of the auxiliary according to Example 1 diluted with water, 2 g of an oil/emulsifier mixture Example 9

26 g of the dyestuff C.I. Acid Orange 24, 20 170
59 g of sodium sulphate,
26 g of the auxiliary according to Example 2 diluted with water,
2 g of an oil/emulsifier mixture Example 10

28 g of the dyestuff C.I. Acid Orange 7, 15 510
51 g of sodium sulphate,
38 g of the auxiliary according to Example 2 diluted with water,
2 g of an oil/emulsifier mixture Example 11

29 g of the dyestuff C.I. Acid Orange 61, 19 320
60 g of sodium sulphate,
18 g of the auxiliary according to Example 1 diluted with water,
2 g of an oil/emulsifier mixture Example 12

52 g of the dyestuff C.I. Acid Brown 14, 20 195
31 g of sodium sulphate,
30 g of the auxiliary according to Example 2 diluted with water,
2 g of an oil/emulsifier mixture Example 13

58 g of the dyestuff C.I. Acid Brown 17, 20 111
32 g of sodium sulphate,
16 g of the auxiliary according to Example 1 diluted with water,
2 g of an oil/emulsifier mixture Example 14

62 g of a dark brown dyestuff, obtained by diazotization of 8-amino-1-naphthol-3,6-disulphonic acid, coupling onto resorcinol, coupling of the dyestuff formed onto 2 equivalents of diazotized 4-amino-4'-nitrodiphenylamine-2'-sulphonic acid, salting out with sodium chloride, filtering off the precipitate with suction and drying it,
21 g of sodium sulphate,
30 g of the auxiliary according to Example 1 diluted with water,
2 g of an oil/emulsifier mixture Example 15

65 g of a dark brown dyestuff, obtained by diazotization of 8-amino-1-naphthol-3,6-disulphonic acid and coupling onto resorcinol/tolamine 4:1, coupling of the dyestuffs formed onto diazotized 4-amino-4'-nitrodiphenylamine-2'-sulphonic acid and onto diazotized 4-nitroaniline, salting out with sodium chloride, filtering off the precipitate with suction and drying it,
23 g of sodium sulphate,
20 g of the auxiliary according to Example 1 diluted with water,
2 g of an oil/emulsifier mixture Example 16

46 g of the dyestuff C.I. Acid Brown 83, 20 250
37 g of sodium sulphate,
30 g of the auxiliary according to Example 1 diluted with water,
2 g of an oil/emulsifier mixture C. Dyeing examples Example 17

100 parts of chrome-tanned calfskin retanned with synthetic tanning substances and having a shaved thickness of 0.7 mm are first wetted back at 50° C. in 1,000 parts of water and 2 parts of technical grade ammonia for 60 minutes. The liquor is discharged, the leather is washed with 1,000 parts of warm water at 50° C. and dyed at 50° C. in 500 parts of fresh water containing 1 part of the dyestuff C.I. Acid Brown 83, 20 250. After a dyeing time of 60 minutes, the bath is acidified with 1.2 parts of 85% strength formic acid to a pH of 3.5. The leather is aftertreated in a new bath consisting of 500 parts of the auxiliary according to Example 1 diluted with 0.45 part of water and at a temperature of 50° C. and crossdyed 10 minutes later with 0.5 part of the same dyestuff. It is then fixed with 0.6 part of 85% strength formic acid, which is followed by a wash cycle, and aftertreatment by means of waterproofing agents and a rinse cycle. Drying, milling and stretching finally give a garment leather having a good penetration dyeing in a reddish medium-brown hue. If the auxiliaries are omitted, the levelness and hiding power of the dyeing are not as good.

Example 18

100 parts of the same leather as in Example 17 are wetted back as described there and washed. 1.5 parts of the undissolved dyestuff/auxiliary preparation of Example 16 are then added to a fresh bath containing 500 parts of hot water at 50° C. After a dyeing time of 60 minutes, the leather is acidified with 2 parts of 85% strength formic acid and finished. A level reddish medium-brown dyeing whose colour depth is comparable to that of the dyeing of Example 17 is obtained.

Example 19

Example 18 is repeated, except that the dyestuff/auxiliary preparation is replaced by an amount of C.I. Acid Brown 83, 20 250 of the same colour strength and 0.45 part of the auxiliary according to Example 1 diluted with water is used for the aftertreatment, to give similar effects.

Example 20

100 parts of chrome-tanned cowhide of 1.8 mm in shaved thickness is retanned in the usual manner by means of synthetic tanning substances, neutralized with 0.5 part of sodium formate and 1 part of sodium bicarbonate and dyed without drying it in between. 2.5 parts of the black dyestuff compound of Example 3 are added to the dyeing liquor consisting of 500 parts of hot water at 40° C. The leather is dyed at 40° C. for 60 minutes. It is then fixed for 30 minutes by means of 2.5 parts of 85% strength formic acid and the dyeing is given a waterproof finish in a new liquor containing 0.5 part of a water-miscible silicone lustre and 1 part of an anionic plasticizer. Drying and mechanical workup give a cow nubuk in a deep black hue. The colour depth is substantially lowered if no auxiliary is used for the dyeing in the presence of the same amount of dyestuff.

Example 21

100 parts of shaved split calf leather of 0.9 mm in shaved thickness are washed, retanned, neutralized and dried in the usual manner. The leather is then pretreated for 2 hours in 1,000 parts of water and 2 parts of technical grade ammonia, rinsed with hot water at 50° C. and dyed in a bath containing 500 parts of water and 1 part of technical grade ammonia at 50° C. for 60 minutes with 8 parts of the undissolved dyestuff compound of Example 3. The dyeing is fat-liquored with 5 parts of native and synthetic fats and fixed at 50° C. with 3.2 parts of 85% strength formic acid for 30 minutes. This is followed by waterproofing, rinsing and mechanical workup to give finally a deep black garment velour. The liquor exhaustion is significantly better than in the dyeing using the same amount of dyestuff without auxiliary.

In the examples which follow, the type of leather, dyestuff and hue of the dyeing are arranged in a table. The dyeings are distinguished by good levelness and perspiration fastness. Bath exhaustion and colour depth are without exception better than in dyeings using the same amount of dyestuff without auxiliary.

| Example | 100 parts of leather | Parts of dyestuff | Dyestuff of example | Hue |
|---|---|---|---|---|
| 22 | wet blue split leather retanned | 3 | 14 | dark brown |
| 23 | wet blue cowhide, retanned | 2 | 9 | orange brown |
| 24 | wet blue cowhide, retanned | 2 | 10 | orange |
| 25 | wet blue cowhide, retanned | 2 | 11 | orange brown |
| 26 | glove leather, dried in between | 10 | 15 | dark brown |
| 27 | wet blue split leather | 3 | 12 | red brown |
| 28 | garment nubuk, retanned | 4 | 5 | red brown |
| 29 | wet blue cowhide, retanned | 3 | 8 | grey |
| 30 | velour split leather, dried in between | 6 | 6 | black |
| 31 | velour split leather, dried in between | 6 | 7 | black |
| 32 | wet blue split leather | 2 | 13 | brown |
| 33 | furniture nubuk, dried in between | 4 | 15 | dark brown |

We claim:

1. Process for the dyeing of leather by means of anionic dyestuffs, characterized in that polyaminoamide resins are used as auxiliaries for the dyeing obtainable by condensation of at least one amine from the series a) diamines of the formula

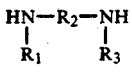

(I)

in which $R_1$, $R_3$, independently of one another, represent hydrogen, unsubstituted or hydroxylsubstituted $C_1$–$C_{10}$-alkyl, or a radical formed-by addition of 2–4 ethylene oxide, propylene oxide and/or butylene oxide, and represents $C_2$–$C_9$-alkylene or a divalent radical of the formula

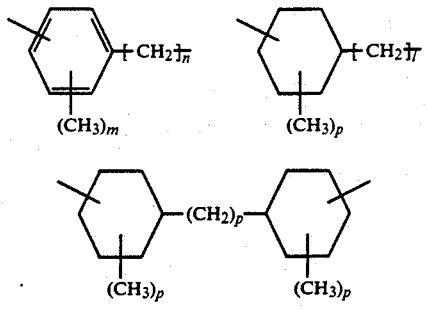

n represents 1 or 2, m, l represents 0 or 1 and p represents 0, 1, 2 or 3, b) piperazine derivatives of the formula

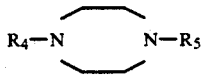

(II)

in which $R_4$, $R_5$, independently of one another, represent hydrogen, $C_1$–$C_4$-alkyl or the radical $R_6$-NH-$R_7$-, $R_6$ represents $C_1$–$C_4$-alkyl and $R_7$ represents $C_2$–$C_4$-alkylene, and c) polyamines of the formula

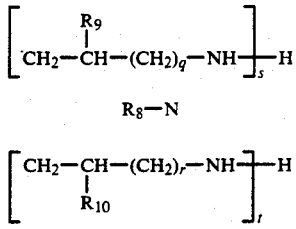

(III)

in which $R_8$ represents hydrogen or unsubstituted or hydroxyl-substituted $C_1$–$C_4$-alkyl, $R_9$, $R_{10}$ independently of one another, represent hydrogen, methyl or ethyl, q, r, independently of one another, represent 0, 1, 2, 3 or 4 and s, t, independently of one another, represent 1, 2, 3, 4, 5 or 6, with at least one aliphatic saturated $C_2$–$C_{12}$-dicarboxylic acid, olefinically unsaturated $C_4$–$C_{12}$-dicarboxylic acid or aromatic dicarboxylic acid or functional derivatives thereof and, if desired, a $C_3$–$C_8$-$\omega$-aminocarboxylic acid or its lactam, in which the amines of the formulae (I), (II) and (III) and the dicarboxylic acids or their derivatives are reacted with one another in such amounts that a molar excess of the amino groups with respect to the carboxyl groups results.

2. The process according to claim 1 wherein $R_1$ and $R_3$ independently of one another represents $C_1C_4$-alkyl.

3. Process according to claim 1, characterized in that the auxiliaries are applied to the leather before or simultaneously with the dyestuffs.

4. Process according to claim 1, characterized in that the auxiliaries are used together with the dyestuff.

5. Process according to claim 1, characterized in that the auxiliaries are miscible with water in any ratio.

6. Dyeing preparations containing at least one anionic dyestuff and a polyaminoamide according to claim 1.

* * * * *

UNITED STATES PATENT AND TRADEMARK OFFICE

CERTIFICATE OF CORRECTION

PATENT NO. : 5,074,884

DATED : December 24, 1991

INVENTOR(S) : Mennicke et al.

It is certified that error appears in the above-identified patent and that said Letters Patent is hereby corrected as shown below:

Col. 1, line 59 Before " represents " insert -- $R_2$ --

Col. 2, line 59 After " $C_8$- " delete " ● " and substitute --ω --

Col. 9, line 67, Before " represents " insert $R_2$--.

Signed and Sealed this

Sixth Day of July, 1993

*Attest:*

Michael K. Kirk

MICHAEL K. KIRK

*Attesting Officer*

*Acting Commissioner of Patents and Trademarks*